US006319042B2

(12) United States Patent
Hirschmann

(10) Patent No.: US 6,319,042 B2
(45) Date of Patent: Nov. 20, 2001

(54) CONTACT CARRIER

(75) Inventor: Michael Hirschmann, Leingarten (DE)

(73) Assignee: Amphenol-Tuchel Electronics GmbH (DE)

( * ) Notice: Subject to any disclaimer, the term of this patent is extended or adjusted under 35 U.S.C. 154(b) by 0 days.

(21) Appl. No.: 09/760,719

(22) Filed: Jan. 17, 2001

(30) Foreign Application Priority Data

Jan. 25, 2000 (DE) ..... 100 02 936
Jul. 22, 2000 (DE) ..... 200 17 840 U

(51) Int. Cl.[7] ..... H01R 13/627
(52) U.S. Cl. ..... 439/352
(58) Field of Search ..... 439/352, 489, 439/372

(56) References Cited

U.S. PATENT DOCUMENTS 5,647,757 * 7/1997 Chrysostomou ..... 439/352
5,749,747 5/1998 Inaba et al. .
5,772,460 6/1998 Baumann .
5,993,230 * 11/1999 Gaulker et al. ..... 439/352
6,102,732 * 8/2000 Seko et al. ..... 439/489

FOREIGN PATENT DOCUMENTS 196 54 294 7/1997 (DE) .
195 34 205 9/1997 (DE) .
197 14 459 10/1998 (DE) .
0 791 987 8/1997 (EP) .
0 975 066 1/2000 (EP) .

* cited by examiner

*Primary Examiner*—Renee Luebke
*Assistant Examiner*—Briggitte R Hammond
(74) *Attorney, Agent, or Firm*—Blank Rome Comisky & McCauley, LLP

(57) ABSTRACT

The invention relates to a contact carrier (connector) for establishing a plug-in connection with an accompanying socket (priming cap) while simultaneously contacting corresponding contact parts of the contact carrier and socket.

14 Claims, 2 Drawing Sheets

Figure 1A:
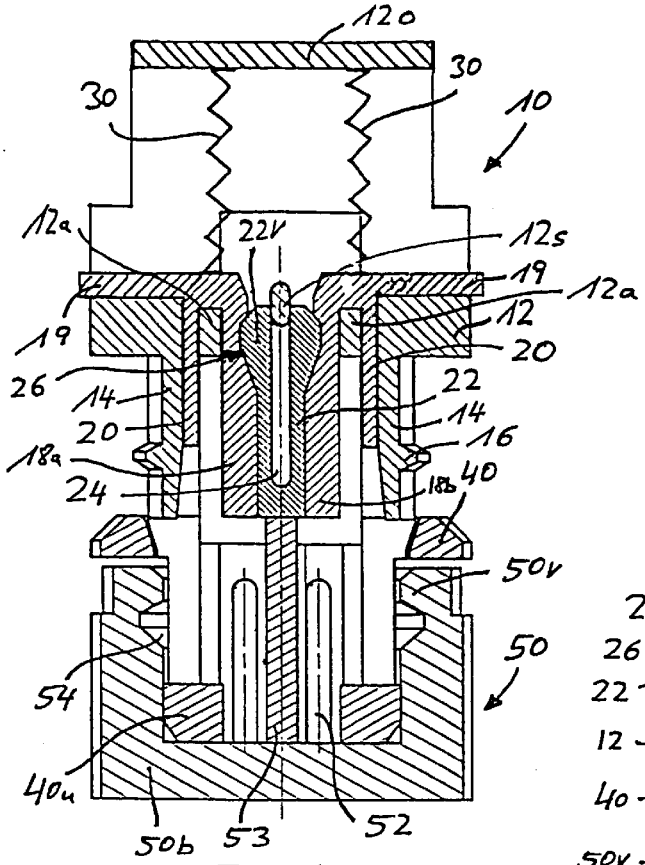

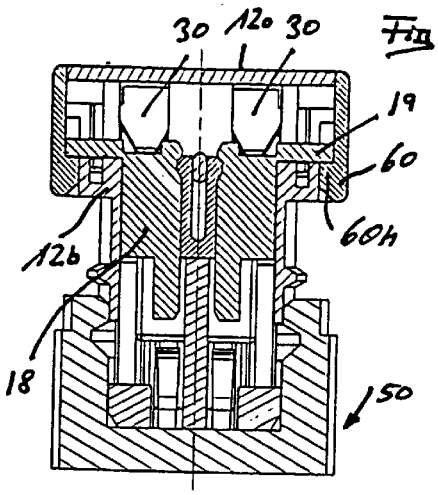
Fig 2a
Fig. 2b
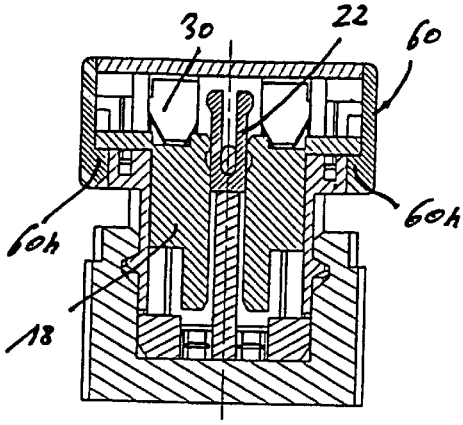
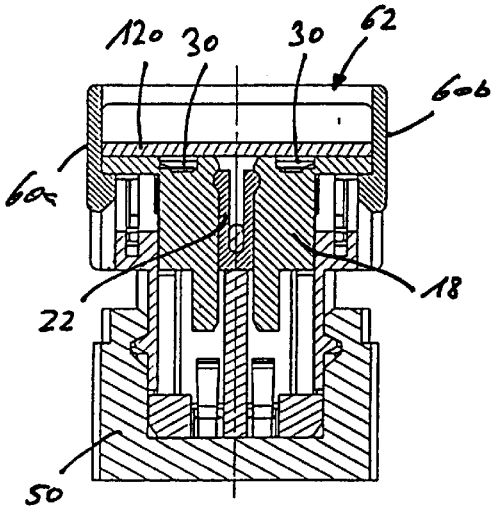
Fig. 2c
Fig. 2d
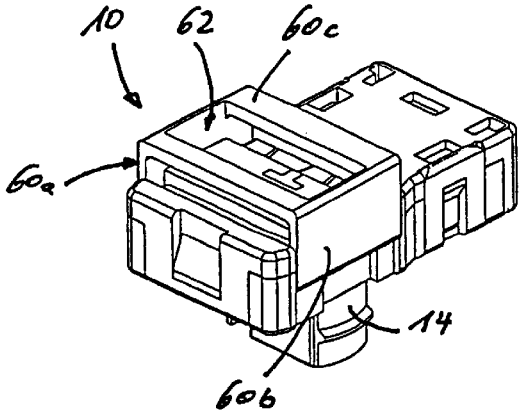

CONTACT CARRIER

DESCRIPTION

The invention relates to a contact(s) carrier (connector) for establishing a plug-in connection with an accompanying socket (receptacle, generator) while simultaneously contacting corresponding contact parts of the contact carrier and socket.

Such a contact carrier is known from DE 195 34 205 C2, and used in restraint systems (seat belts, airbags) in motor vehicles, for example. In this case, high functional reliability is required in addition to easy assembly.

This applies in particular with respect to the latching of contact carrier and socket, wherein one requirement is that the contact parts (contact springs) of the one component establish a reliable contact with the contact parts (contact pins) of the other component in an assembled (connected) position, and another requirement is to ensure that the contact carrier and socket do not become unintentionally detached from each other again.

This problem is solved in the aforementioned prior art by contacting and latching the contact carrier and socket in a first step, and, in a second step, routing an interlocking component as a so-called secondary locking means behind latching arms of the contact carrier to secure the latch against unintended release.

The object of this invention is to describe a way in which the contact carrier and accompanying socket (or respective contact parts) can be latched in a single step, while simultaneously ensuring that the contact parts come into contact and contact carrier and socket are locked only after a proper and complete assembly has been achieved.

The basic concept underlying the invention is to build a safety mechanism into the contact carrier that can only be activated if latching (locking) means of the contact carrier have latched with the accompanying latching (locking) means of the socket, and only thereafter triggering a secondary locking system if provided, while the contact carrier again detaches from the socket on its own in the event of an incomplete assembly.

In this way, the assembler reliably detects an incomplete interlocking of contact carrier and socket, and can initiate a new plug-in process. This reliably prevents incorrect interlocking and an associated safety risk.

In its most general embodiment, the invention therefore relates to a contacts carrier for establishing a plug-in connection with an accompanying socket while simultaneously contacting corresponding contact parts of the contacts carrier and socket, with the following features:

A slider is situated in the contacts carrier;

The slider can be moved parallel to the direction of movement of the contacts carrier, and loaded by at least one spring in the direction of movement of the contacts carrier;

The slider is held by an element that releases the slider loaded by the spring(s) only if latching arms of the contact carrier projecting in the plug-in direction of the contacts carrier have been latched in corresponding latching recesses of the socket, and the contacts carrier has reached its final plug-in position relative to the socket.

In other words, to assemble (interlock) the contact carrier and socket, the contact carrier (with its contact parts, e.g., contact springs) is placed on an accompanying socket and pressed forward against it, until its resilient latching arms latch into corresponding latching recesses of the socket.

Up to this point, the mentioned slider remains in its original position, namely by the cited element, which positively holds the slider up to this time.

Only when the latching arms of the contact carrier latch into the latching recesses of the socket the said element releases said slider, which is then pushed into the plug-in direction of the contact carrier by the mentioned spring. According to one embodiment, the slider has interlocking arms that freely project in the plug-in direction of the contact carrier. After the slider has been released, the interlocking arms of the slider can be routed behind the latching arms of the contact carrier, securing them against unintended release, and then trigger a secondary interlocking of the latching arms of the contact carrier.

If the plug-in procedure of contact carrier and socket was not performed completely, meaning if the latching arms of the contact carrier have not been latched into the latching recesses of the socket, the spring causes the contact carrier to again be returned from the position achieved relative to the socket to its initial position as soon as the assembler releases the contact carrier.

Therefore, there is an interaction based on the spring arrangement between the slider and contact carrier. On the one hand, the spring causes an adjustment of the slider in case of proper interlocking of contact carrier and socket. On the other hand, the spring causes the contact carrier to return in case of an incomplete plug-in connection (further detachment of the contact carrier from the socket).

According to one embodiment, one end of the spring is supported against the slider, and the other end against the contact carrier. The spring can be a plate spring (leaf spring) or spiral spring, depending on the contact carrier design. A spiral spring will be preferred in particular for a more or less cylindrical shape of the contact carrier; a plate spring can be selected if the contact carrier is offset, as shown in DE 195 34 205 C2.

The element can consist of a spigot arranged in the slider, wherein a pin connected with the contact carrier is guided in the peg, parallel to the movement of the contact carrier. The contact carrier and pin can be made as one piece. As a direct consequence, the pin follows the contact carrier (the contact carrier casing) wherever it moves.

In one embodiment, the spigot has an axial groove running parallel to the direction of movement of the contact carrier and open to the top, along which the pin is routed.

The top end of the peg can have a thickened area that lies in a corresponding recess of the slider with the contact carrier not plugged in, and holds the spring-loaded slider in place relative to the pivot (positively).

In another embodiment, the slider, spigot and pin are designed and arranged in such a way that, when the contact carrier is in its final plug-in position relative to the socket, the pin assumes a position relative to the spigot in which the spigot is released from a positive connection with the slider under the influence of the springs, and the slider is adjusted relative to the contact carrier based on the force of the springs.

In other words, given a lacking or incomplete plug-in condition of the contact carrier relative to the socket, the pin in the axial groove of the spigot assumes a position in which the pin holds the spigot in a positive connection relative to the slider. Only when the contact carrier has been advanced onto and into the socket to where its latching arms have latched in the latching recesses of the socket the pin reaches a position within the spigot where the spigot is released form the positive connection with the slider by the force of the spring, so that the slider can be adjusted in a direction toward the socket, e.g., to assume simultaneously the desired position of the secondary interlock relative to the latching arms of the contact carrier with its interlocking arms.

In the described embodiment of the spigot with the axial groove open to the top, this is achieved when the pin has reached the bottom (floor) of the axial groove, so that the two upper, thickened sections of the spigot can deform against each other (into the axial groove), and the positive fit is dissolved. Another possibility involves designing in particular the interlocking part of the spigot relative to the slider out of a resilient material, which permits a deformation during exposure to the spring load that releases the spigot from the positive fit relative to the slider once the pin has been removed from this area.

The mentioned contact carrier enables the desired interlocking with an accompanying socket in a single step, including accompanying secondary interlocking, since the sliders, as stated, is automatically adjusted by the force of the spring as soon as the contact carrier has reached its proper locking position relative to the socket.

If it becomes necessary to release the contact carrier from the socket at a later point, the invention provides for an embodiment in which the slider has at least one projection that extends in a hole in the contact carrier accessible from outside. For example, a tool can be introduced through the hole for gripping the projection and move it away from the socket, so that the secondary locking means can be released and the contact carrier can then be taken out of the socket again.

This embodiment can be modified further by having the slider have at least one projection extending through the hole in the contact carrier to the outside, preferably two diametrically opposed projections, which can then be manipulated by hand to move the slider away from the socket in this way and release the secondary interlock. The contact carrier can then be taken out of the latching recesses of the socket as its latching arms deform.

The mentioned projections on the slider are arranged perpendicular to the direction of movement of the slider, for example. This makes it easier to return the slider by hand.

Even though the contact carrier can be interlocked with the socket in a single step, as described, a two-step interlocking procedure takes place, namely the latching arms of the contact carrier are first latched in the latching recesses of the socket, after which secondary interlocking occurs via the interlocking arms of the slider.

This technique can be further modified by arranging and designing the locking arms of the slider in such a way that they release an accompanying short-circuit spring between the contact parts (contact pins) of the socket just before reaching their safety position relative to the latching arms of the contact carrier.

This ensures that the short-circuit bridge formed by the short-circuit spring is only released reliably if the secondary interlocking system also becomes activated, i.e., when both contact carrier and socket interlocking as well as their mutual contact parts have been properly locked.

In another embodiment, the contact carrier has a disassembly slider that overlaps the slider and spring(s) loading the slider at least laterally, and fastens from below to a corresponding projection of the slider on its end facing the socket.

This prevents the slider from being blocked during assembly if the assembler grips the contact carrier laterally. The disassembly slides protects those parts of the contacts carrier arranged behind it. The design of the disassembly slider ensures that the slider can be pulled out of the interlocking position by means of the disassembly slider, but otherwise can move freely relative to the disassembly slider. At the same time, the slider is protected against unintended contact.

Additional features of the invention are described in the features in the subclaims and in the remaining application documents.

The invention will be explained in greater detail below based on two embodiments.

In this case, FIGS. 1*a*, 1*b* and 1*c* and 2*a*, 2*b* and 2*c* each show diagrammatic sectional views of two alternative allocations of a contact carrier to a socket during the plug-in procedure in three different assembly positions each.

FIG. 2*d* is a perspective view of the contact carrier corresponding to the embodiment of FIGS. 2*a* to 2*c*. Identical or similarly acting components are marked with the same numerals.

A contact carrier is marked 10, while the allocated socket is denoted by 50.

The contact carrier 10, whose contact springs are not shown, encompasses a casing 12, from which two latching arms 14 with outwardly extending latching projections 16 extend toward the socket 50.

Located inside the casing 12 is a slider 18 that runs coaxially to the central longitudinal axis M of the contact carrier 10, and which comprises a two-part base section, wherein the two segments 18*a, b* of the base section 18 at the top end are offset by 180° toward the outside, followed by two interlocking arms 20, whose respective free ends run toward the socket 50 and parallel to the central longitudinal axis M of the contact carrier 10.

In the assembly position shown on FIG. 1*a* (before the plug-in procedure), the slider 18 correspondingly abuts segments 12*a* of the casing 12.

Located between the two segments 18*a*, 18*b* of the base section is a spigot 22 having a slit 24 open to the top and running coaxially to the central longitudinal axis M, whose upper end abuts a pin 12*s* that is integral with the remaining parts of the casing 12 (one piece).

The lower end of the spigot 22 rests against a web 53, which projects upward from a bottom 50*b* of the socket 50, coaxially to the central longitudinal axis M.

The lower ends of two springs 30 rests against the top face of the slider 18. The top end of the springs 30 abuts (touches) an upper segment 12*o* of the casing 12.

Situated between the socket 50 and contact carrier 10 is an insulating ring 40, which extends into the socket like a pot, and whose bottom segment 40*u* rests on the floor 50*b* of the socket 50.

In the socket 50 two contact pins 52 may be seen, which run parallel to the central longitudinal axis M towards the contact carrier 10, and are arranged in such a way that accompanying contact springs (not shown) of the contact carrier 10 run onto the contact pins 52 as the plug-in procedure continues, slipping over and contacting them.

In the initial position shown on FIG. 1*a*, the outside of the interlocking arms 20 of the slider 18 lies against the inner faces of the latching arms 14.

Figure 1B:
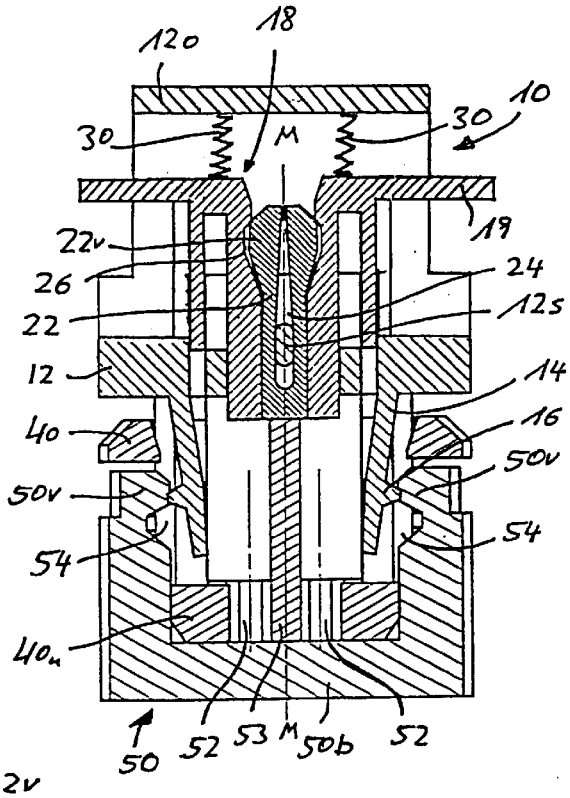

To interlock the contact carrier 10 and socket 50, the assembler grasps the casing 12 and presses it towards the socket 50 (FIG. 1*b*). In this case, the latching arms 14 of the contact carrier 10 initially run onto the insulating ring 40 and projections 50*v* of the socket 50 located behind it (during which they are each bent inwardly, as shown on FIG. 1*b*), before subsequently latching in the corresponding latching recesses 54 of the socket 50.

Up to this time, the position of the slider 18 remains unchanged, specifically due to the locking effect of the spigot 22, whose thickened areas 22*v* at the upper end are lying inside corresponding recesses 26 of the slider 18.

Figure 1C:
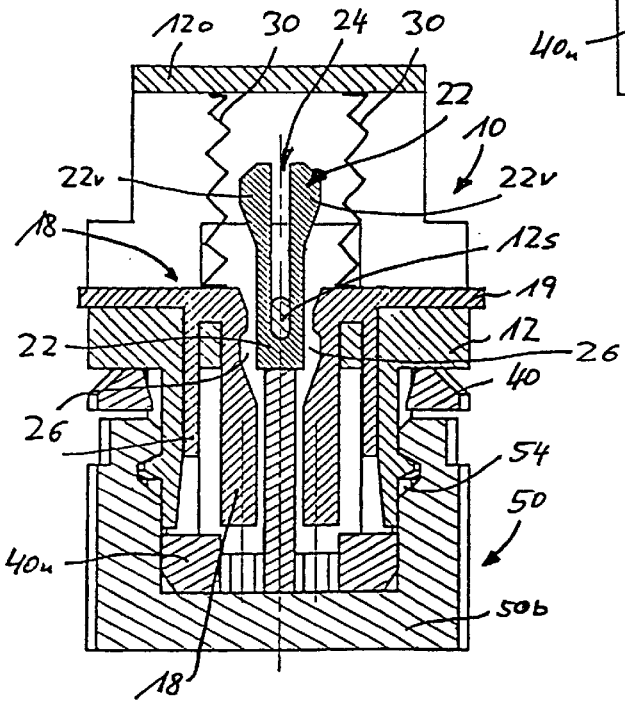

Shortly before or while spring-loading of the latching arms 14 into the latching recesses 54, the springs 30 are tensioned according to FIG. 1*b*, and thereby cause the slider 18 to move towards the socket 50 at the time when the latching arms 14 are guided into the latching recesses 54, whereby the interlocking arms 20 of the slider 18 are (again) routed behind the interlocking arms 14 of the contact carrier 10 (FIG. 1*c*).

The slider 18 is allowed to move by virtue of the fact that the pin 12*s* has reached its deepest location within the slit (the groove) 24 at this time, and the thickened segments 22*v* of the spigot 22 can move inwardly, thereby being released from the recesses 26 (FIG. 1*b*).

The springs 30 expand again at the same time (FIG. 1*c*).

Thus FIG. 1*c* shows the completely and reliably plugged-in state of the contact carrier 10 and socket 50, in which the contact springs (not shown) of the contact carrier 10 slip over and contact the contact pins 52 of the socket 50.

In addition, while moving towards the socket 50, the interlocking arms 20 of the slider 18 cause a short-circuit bridge (not shown) formed between the contact pins 52 to be released just before reaching the maximal insertion position of the slider 18 into the socket 50.

If the contact carrier 10 has (still) not been completely inserted into the socket 50 (FIG. 1*b*) and the plug-in procedure is interrupted at this point for whatever reason, the tensioned springs 30 (FIG. 1*b*) automatically cause return of the contact carrier 10 to the initial position shown on FIG. 1*a*, thereby reliably avoiding an incomplete plug-in position.

Should it become necessary to detach the contact carrier 10 from the socket 50 again after the contact carrier 10 and socket 50 have been completely plugged together, this can be done using arms 19 of the slider 18 extending perpendicular to the central longitudinal axis M, which are routed into corresponding holes of the casing 12, wherein the arms 19 can be gripped manually from the outside. As soon as the slider 18 has been detached from the socket 50 by hand in this way, the secondary locking position for the latching arms 14 of the contact carrier 10 becomes no longer necessary, so that the contacts carrier can subsequently be detached from the socket 50 again.

The embodiment shown in FIGS. 2*a–d* corresponds to FIGS. 1*a–c* in terms of its basic setup, so that only enhanced/modified structural features will be described below.

Only the upper arms 19 of the slider 18 are placed on the casing 12 (at 12*b*).

Situated adjacent to this casing part 12*b* and arms 19 is a disassembly slider 60, which has two side surfaces 60*a, b* and an upper cover 60*c*, which has a recess 62 in which the upper casing segment 12*o* is placed accordingly to FIG. 2*a*. The lower end of side surfaces 60*a, b* (toward the socket 50) has inwardly running hooks 60*h* on which the slider 18 rests with its arms 19 according to FIG. 2*a*.

Assembly takes place as described in FIGS. 1*a–c*. The disassembly slider 60 is gripped and routed down, toward the socket 50. The casing 12 is taken along in the process until the latching arms 14 move into the recesses 54. As an alternative, assembly can also take place by pressing on the casing part 120. In this case, the disassembly slider 60 is taken along. The slider 18 now releases from the spigot 22, gliding down under the force of the springs 30 and securing the latching arms 14. The springs 30 expand at the same time (FIG. 2*b*).

In turn, disassembly takes place with the disassembly slider 60, which is routed up (away from 50) and takes along the slider 18 with its hooks 60*h* (FIGS. 1*c*, 1*d*).

What is claimed is:

1. A contact carrier assembly establishing a plug-in connection with an accompanying socket while simultaneously contacting corresponding contact parts of the contact carrier and socket said assembly comprising:

a slider situated in the contact carrier;

the slider being arranged to be moved parallel to a direction of movement of the contact carrier, and loaded by at least one spring in the direction of movement of the contact, carrier;

the slider being held by an element that releases the slider loaded by said at least one spring only if latch arms of the contact carrier projecting in a plug-in direction of the contact carrier have been latched in corresponding latching recesses of the socket and the contact carrier has reached its final plug-in position relative to the socket.

2. The contact carrier assembly according to claim 1, in which the at least one spring loading the slider is supported against the slider at one end and against the contact carrier at the other end.

3. The contact carrier assembly according to claim 1, in which the element comprises a spigot located in the slider, along which a pin connected with the contact carrier guided parallel to any movement of the contact carrier.

4. The contact carrier assembly according to claim 3, in which the spigot has an axial groove running parallel to the direction of movement of the contact carrier and open to the top, along which the pin is routed.

5. The contact carrier assembly according to claim 3, in which the spigot provides a thickened position at an upper end, said thickened portion being placed in a corresponding recess of the slider with the contact carrier not plugged in, and holding the slider loaded by the at least one spring in place relative to the spigot.

6. The contact carrier assembly according to claim 3, in which the slider, spigot, and pin are designed and arranged in such a way that, when the contact carrier is in its final plug-in position relative to the socket the pin assumes a position relative to the spigot in which the spigot is released from a positive connection with the slider during exposure to the at least one spring, and the slider is adjusted based on the force of the at least one spring relative to the contact carrier.

7. The contact carrier assembly according to claim 3, in which the spigot is arranged in such a way as to be supported on an accompanying bearing of the socket during the plug-in procedure of the contact carrier.

8. The contact carrier assembly according to claim 1, in which the slider has at least one projection that extends in a hole in the contact carrier accessible from outside.

9. The contact carrier assembly according to claim 8, in which the slider has at least one projection extending through the hole in the contact carrier to the outside.

10. The contact carrier assembly according to claim 8, in which the projection runs perpendicular to the direction of movement of the slider.

11. The contact carrier assembly according to claim 1, in which the slider has latching arms that freely project in the plug-in direction of the contact carrier, which, after the slider has been released, are routed behind the latching arms of the contact carrier securing them against unintended release.

12. The contact carrier assembly according to claim 11, in which the latching arms of the slider are arranged and designed in such a way that they release an accompanying short-circuit spring between the contact parts of the socket just before reaching their final position relative to the latching arms of the contact carrier.

13. The contact carrier assembly according to claim 1, with a disassembly slider that overlaps the slider and the at least one spring loading the slider at least laterally, and supporting a corresponding projection of the slider on its end facing the socket.

14. The contact carrier assembly according to claim 13, in which the disassembly slider has an overall height that it contains the at least one spring and any components bordering the spring at its end.

* * * * *